US005084332A

United States Patent [19]

Burgess

[11] Patent Number: 5,084,332

[45] Date of Patent: Jan. 28, 1992

[54] NONWOVEN FABRIC FOR SHOE COUNTERS

[75] Inventor: Kenneth W. Burgess, Seneca, S.C.

[73] Assignee: Phillips Petroleum Company, Bartlesville, Okla.

[21] Appl. No.: 491,142

[22] Filed: Mar. 9, 1990

[51] Int. Cl.[5] ..... A43B 13/42; A43B 23/08; B32B 5/06; B32B 7/00

[52] U.S. Cl. ..... 428/219; 12/146 D; 28/110; 28/112; 28/115; 36/68; 36/69; 156/148; 156/272.2; 156/273.7; 428/220; 428/296; 428/300; 428/301; 428/409

[58] Field of Search ..... 428/219, 220, 296, 300, 428/301, 409; 28/110, 112, 115; 156/148, 272.2, 273.7

[56] References Cited

U.S. PATENT DOCUMENTS

| | | | |
|---|---|---|---|
| 4,105,381 | 8/1978 | Platt et al. | 425/83.1 |
| 4,154,889 | 5/1979 | Platt | 428/234 |
| 4,199,644 | 4/1980 | Platt | 428/300 |
| 4,308,673 | 1/1982 | Mobius | 36/68 |
| 4,320,167 | 3/1982 | Wishman | 28/112 |
| 4,342,813 | 8/1982 | Erickson | 428/296 |
| 4,350,732 | 9/1982 | Goodwin | 428/246 |
| 4,381,611 | 5/1983 | Wishman | 34/9 |
| 4,416,936 | 11/1983 | Erickson et al. | 428/300 |
| 4,540,414 | 9/1985 | Wishman | 604/378 |
| 4,582,750 | 4/1986 | Lou et al. | 428/300 |
| 4,594,283 | 6/1986 | Ohigashi | 428/300 |
| 4,814,219 | 3/1989 | Burgess et al. | 428/300 |

FOREIGN PATENT DOCUMENTS 2024279A 6/1979 United Kingdom .

*Primary Examiner*—James C. Cannon
*Attorney, Agent, or Firm*—Hal Brent Woodrow

[57] ABSTRACT

A nonwoven fabric and a process for making a nonwoven fabric consisting essentially of:

(a) forming a carded web of staple fibers selected from the group consisting of polypropylene fibers, cellulose acetate fibers, nylon fibers, acrylic fibers, and combinations of two or more thereof, having a denier in the range of from about 1½ denier to about 10 denier;

(b) crosslapping said carded web to for a suitable batt;

(c) needling said batt with a needle punch density of from about 500 to about 2000 needle punches/-square inch to form a fabric having a first smooth fabric surface and a second fabric surface opposite to said first surface;

(d) fusing said second surface in a manner which provides a light fusion of the staple fibers making up said second surface;

thereby providing a nonwoven fabric weighing in the range of from about 6 ounces/square yard to about 10 ounces/square yard with a thickness of from about 65 millimeters to about 90 millimeters.

20 Claims, No Drawings

NONWOVEN FABRIC FOR SHOE COUNTERS

FIELD OF THE INVENTION

This invention relates to a novel nonwoven fabric and process for making said nonwoven fabric suitable for use in making one-piece shoe counter for the heel region of a shoe.

BACKGROUND OF THE INVENTION

Normally shoes have a heel region composed of at least three separate shaped layers: (1) the upper or outer surface of the shoe; (2) a stiffening member placed in contact with the upper; and (3) a velvety or felt facing material which is attached to the stiffening member and will come in contact with the heel of the foot. To manufacture this part of the shoe many separate steps are required both to make the three separate pieces and to assemble them into the heel region of a shoe. To simplify shoe production several attempts have been made to combine the stiffening member with the facing material thereby creating what is commonly called a one-piece shoe counter.

One technique for making a material which could be used to make one-piece shoe counters is disclosed in U.S. Pat. No. 4,308,673. This patent discloses making this material by loading a fiber structure with a synthetic resin, then heat treating the loaded fiber structure to form a stiffened fabric-like material. Unfortunately the product produced by this process must be subsequently buffed on one side to provide the highly desirable velvety or felt facing which will contact the heel area of the foot. Additionally the stiffened fabric produced by this process tends to produce shoe counters which allow the adhesive to soak through the shoe counter when adhesively joined to the shoe upper by hot melt cements. Where the adhesive soaks through the shoe counter hard discolored spots will be formed which ruin the velvety or felt handle and finish of the facing material. These spots also are unacceptable because they will be abrasive to the hose or heel region of the foot.

Thus it would be a significant contribution to the art to develop a process for producing a nonwoven fabric suitable for use in the manufacture of one-piece shoe counter which provides a velvety or felt facing side which is formed without abrasive buffing.

Additionally it would be a significant contribution to the art to develop a nonwoven fabric which does not allow adhesives, used to attach the one-piece counter to the shoe upper, to soak through the shoe counter.

It is thus an object of this invention to provide a process for producing a nonwoven fabric suitable for use in the manufacture of one-piece shoe counter which provides a velvety or felt facing side which is formed without abrasive buffing.

It is also a further object of this invention to provide a nonwoven fabric which does not allow adhesives, used to attach the one-piece counter to the shoe upper, to soak through the shoe counter.

Other aspects, objects, and several advantages of this invention will be apparent from the foregoing disclosure.

SUMMARY OF THE INVENTION

In accordance with the present invention, I have discovered a nonwoven fabric particularly well suited for utilization in shoe counters wherein said nonwoven fabric consists essentially of a nonwoven fabric having two fabric surfaces made from staple fiber selected from the group consisting of polypropylene fibers, cellulose acetate fibers, nylon fibers, acrylic fibers, and combinations of two or more thereof, having a denier in the range of from about 1½ denier to about 10 denier, weighing in the range of from about 8 ounces/square yard to about 9.4 ounces/square yard, with a thickness of from about 65 millimeters to about 90 millimeters which has been needle punched with in the range of about 500 to about 2000 needle punches/square inch in a manner which provided a velvety or felt first fabric surface and a second fabric surface which has a fused surface.

In accordance with another aspect of the present invention I have also discovered a process for making a nonwoven fabric consisting essentially of:

(a) forming a carded web of staple fibers selected from the group consisting of polypropylene fibers, cellulose acetate fibers, nylon fibers, acrylic fibers, and combinations of two or more thereof, having a denier in the range of from about 1½ denier to about 6 denier;

(b) crosslapping said carded web to form a suitable batt;

(c) needling said batt with a needle punch density of from about 500 to about 2000 needle punches/-square inch to form a fabric having a first smooth fabric surface and a second fabric surface opposite to said first surface;

(d) fusing said second surface in a manner which provides a light fusion of the staple fibers making up said second surface;

thereby providing a nonwoven fabric weighing in the range of from about 6 ounces/square yard to about 10 ounces/square yard with a thickness of from about 65 mils to about 90 mils.

DETAILED DESCRIPTION OF THE INVENTION

The nonwoven fabric of the present invention should have a smooth first fabric surface with few if any face defects having an even appearance and a hand suitable to provide velvety or felt texture for contacting the foot in the heel region of the shoe. The velvety or felt texture characteristic of this fabric could also be described as having a surface slightly napped in finish. The second fabric surface of the nonwoven fabric may originally contain many defects (such as loop defects). However, the second surface of the nonwoven fabric prior to its utilization in the present invention must be lightly fused to help block adhesives and/or solvent from penetrating through the second fabric surface to the first fabric surface.

The nonwoven fabric of the present invention should weigh in the range of from about 6 ounces/square yard to about 10 ounces/square yard and preferably, from 8 ounces/square yard to 9.4 ounces/square yard. Presently it is most preferred that the nonwoven weight be about 8.6 ounces/square yard. It is also important that the nonwoven fabric have a semi-uniform thickness from in the range of about 65 mils to about 90 mils, preferably the nonwoven fabric will range in thickness from about 65 mils to about 80 mils. Most preferably the nonwoven fabric will have a thickness in the range of 75 mils to 80 mils.

Suitable staple fibers for making the nonwoven fabric utilized for the practice of the present invention include limited to synthetic fibers such as those selected from the group consisting of polypropylene fibers, cellulose acetate fibers, nylon fibers (polyamide fibers), acrylic fibers, and combinations of two or more thereof. It is also contemplated that blends of fibers composed of predominately the previously mentioned synthetic fibers and other staple fibers having a higher melting point or degradation temperature above the melting point of the previously discussed synthetic fibers may also be used in the practice of the present invention. Particularly preferred for the practice of this invention are polypropylene staple fibers.

The nonwoven fabric of the present invention should be made of staple fiber with a denier in the range of from about 1½ to about 10 denier. Preferably the denier of the staple fiber will be in the range of from about 3 to about 5 denier. Lower denier staple fibers are preferred because the nonwoven fabric produced from lower denier staple fibers have a "tighter" fabric structure which minimizes the possibility that adhesives applied to one side of the fabric will soak through to the other side. Denier blends can also be utilized such as a equal blend of 3 and 5 denier fibers. The staple fiber length should also range from about 2 inches to about 4 inches and preferably will be about 3¼ inches to provide the best fabric strength.

The nonwoven fabric of the present invention may be formed from the above described staple fibers by carding the staple fibers to form a web. The web should then be cross-lapped until a sufficient number of layers to form a batt which will result in a nonwoven fabric of the weight described above after needle punching.

Needle punching the web to form the nonwoven fabric should be performed in a manner which provides a smooth first fabric surface to the nonwoven fabric (with few if any loop defects, an even appearance and a good felt-like handle). To accomplish these ends needle punching should be performed with in the range of from about 500 to about 2,000 needle punches/square inch, and preferably from at least 1,000 to 1,200 needle punches/square inch. The needle size should vary from about 32 to about 40 gauge. Presently preferred are 36 gauge needles because of their smooth action and reduced tendency to break over finer gauge needles. One suitable method of providing the smooth first fabric surface (which is critical to providing the suitable velvety or felt fabric surface texture) is to reduce the up stroke in the needling process.

It is recommended that the fabric be cold pressed before the surface fusion is performed. Cold pressing between two rollers or the like, reduces the loft of the fabric and provides a uniform fabric thickness across the fabric's width.

The second fabric surface can be formed by treating the nonwoven fabric surface opposite the smooth first fabric surface in a manner which provides a lightly fused surface. Many suitable methods for providing surface fusion are known to those skilled in the art. One suitable method is to apply a hot calendar roll to the fabric surface at a suitable temperature and for a suitable time to fuse only the surface fibers of the nonwoven fabric. Another suitable method would be to use an infrared heat source with cold calendar rolls to plastize the outer surface only.

The nonwoven fabric may then be loaded with a thermoplastic resin which will act as a stiffening agent. Thermoplastic resins used as stiffening agents must have a melting point lower than the melting point of the staple fiber or staple fiber blend employed in the nonwoven fiber onto which the thermoplastic will be impregnated. Suitable synthetic resins include but are not limited to thermoplastic resins selected from the group consisting of homopolymers of styrene, copolymers of styrene, homopolymers of acrylates and copolymers of acrylates. Suitable acrylates would include but are not limited to acrylate, methyl acrylate, ethyl acrylate, and the like. Examples of suitable synthetic resins include but are not limited to synthetic resins selected from the group consisting of homopolymers of styrene, copolymers of styrene and butadiene, terpolymers of acrylonitrile, butadiene and styrene, copolymers of styrene and acrylic acid, copolymers of styrene and salts of acrylic acid, copolymers of styrene and methacrylic acid, copolymers of styrene and salts of methacrylic acid, copolymers of styrene and methyl acrylate, copolymers of styrene and methyl methacrylate, and copolymers of styrene and ethyl acrylate. Preferred for the practice of the present invention are copolymers of styrene and ethyl acrylate such as W. R. Grace Darex 444.

The thermoplastic resins may be loaded into the nonwoven fabric by any means which disperses of the thermoplastic resin uniformly through the interstitial space of the nonwoven fabric. One suitable method for loading the thermoplastic resin onto the nonwoven fabric is to immerse the nonwoven fabric in a trough or container wherein the thermoplastic resin is present in an emulsion. The thermoplastic resin should ideally be provided in an aqueous emulsion consisting of in the range of about 40 to about 60 part thermoplastic resin solids. Additionally filler, stabilizer, processing aids and dyes or pigments may also be provided with the thermoplastic resin utilized in the present invention. The amount of thermoplastic resin loaded on the nonwoven fabric should be controlled by utilizing a pair of squeeze rolls or doctor rolls on the loaded nonwoven fabric after it exits the trough containing the thermoplastic resin.

It is believe necessary that the effective amount of thermoplastic resin be controlled by utilizing squeeze rolls or doctor rolls, to remove any excess thermoplastic resin. It appears that by utilizing squeeze rolls that the limited amount of thermoplastic resin remaining in the loaded nonwoven fabric is substantially removed from the first fabric surface of the nonwoven fabric heretofor described. It is recommended that the squeeze rolls compress the loaded nonwoven fabric in the range of from about ⅓ to about 1/5 of the nonwoven fabrics original thickness and more preferably from about ¼ the nonwoven fabrics original thickness. For example a nonwoven fabric of an original thickness of about 0.065 mils would most preferably be squeezed to a thickness of 0.017 mils by the squeeze rolls.

It has been found particularly advantageous to utilize a base hue provided by either the staple fiber or a dye suitable for the thermoplastic resin to be able to generate many desirable colors and an evenly colored final appearance for the nonwoven composite. If the staple fiber is a nondyable colored synthetic resin utilized to provide the base hue, a small but effective amount of white coloring agent should be utilized in a normally translucent thermoplastic resin. The effective amount of white coloring agent added to a translucent thermoplastic resin results in the shoe counter appearing to have a uniform color reflectivity or evenly colored appearance. However, if the thermoplastic resin is utilized to provide the base hue, pastel colors can be generated utilizing a white nondyable synthetic resin and relying on the coloring agent in the thermoplastic resin to provide the coloration.

The loaded nonwoven fabric may optionally be dried to substantially remove the water which has been entrained in the loaded nonwoven fabric. Suitable drying means are known to those skilled in the art and include but are not limited to forced air drying systems. The forced air should be provided with an air flow rate and air temperature which maintains the nonwoven fabric and thermoplastic resin in a temperature range of from about 100° F. to about 250° F. It is preferred for the practice of the present invention that the nonwoven fabric and thermoplastic resin be maintained during the drying process in a temperature range of 110° F. to 140° F., and preferably at a temperature of 130° F.

It is desirable that the resin-locked nonwoven fabric has a total dry weight (with no emulsifier present) of in the range of about 17 ounces/yard to about 26 ounces/yard, preferably in the range of 19 ounces/yard to 22 ounces/yard. This roughly correspondes to the nonwoven composite being comprised of in the range of from about 70 to about 50 percent curable thermoplastic resin by weight.

The thermoplastic resin-loaded nonwoven fabric should next be heat treated to melt the thermoplastic resin so that it will flow around the fiber of the nonwoven fabric, thereby forming the nonwoven composite. The heat treatment temperature, however, must be lower than the melting point of the staple fiber in the nonwoven fabric. Suitable heating means for heating continuous fabric rolls are known to those skilled in the art. One suitable means is a Festone Oven wherein the fabric temperature is monitored by infrared detectors. It is preferred that the heat treatment temperature of the resin-loaded nonwoven fabric be maintained at a temperature of from about 200° F. to about 250° F. and preferably 225° F. (particularly when polypropylene is used as the fiber and a copolymer of styrene and ethyl acrylate is used as the thermoplastic resin).

After the nonwoven composite is formed it may optionally be pressed between two calendar rolls to press the nonwoven composite to a uniform thickness. Preferably these calendar rolls will be chilled to permanently set the thickness of the nonwoven composite. For example a nonwoven composite formed from a nonwoven fabric with an original thickness of about 0.065 inch after being loaded with a suitable amount of thermoplastic resin and cured is ideally be pressed to a thickness of in the range of from about 0.052 to 0.057 inches.

At this point the first fabric surface of the nonwoven composite will have a velvety, felt-like texture which could be also described as being a surface with a slightly napped finish. The opposite side of the nonwoven composite which has a light surface fusion may then be treated with adhesives to allow the nonwoven composite to be affixed to the heel region of the shoe. Many suitable adhesives are known to those skilled in the art, however, preferred currently are hot melt adhesives.

Hot melt adhesives suitable for use in shoe manufacture are well known to those skilled in the art. The hot melt adhesive activation temperature must be lower than the staple fiber or staple fiber blend's melting temperature. In shoe manufacture it is preferred that the activation temperature be in the range of about 140° F. to about 280° F. and it is most preferred that the hot melt adhesive activation temperature range from about 140° F. to about 200° F.

One suitable type of hot melt adhesive can be prepared by blending mainly ethylene-vinyl acetate copolymers and at least one additive such as tackifiers, waxes, asphalts, rubbers, plasticizers, nonadhesive resins, pigments and fillers. The adhesive may be applied to the second fabric surface of the nonwoven fabric utilizing any suitable coating method including but not limited to utilizing a roller, curtain, brush, spray or blade coating system. Optionally the nonwoven composite can be cut into shoe counter blanks and the adhesive applied after the shoe counter blanks are cut out or upon assembly of the shoe.

The nonwoven composite is produced generally in large sheet which are cut and skived to the shoe manufacturer's specification to provided a shoe counter blank. The shoe manufacturer specification for the blank will depend on the style of shoe which is being manufactured. The shoe counter blank 2 will then be matched to the shoe's upper 4 and affixed thereto by suitable means such as adhesives or stiching. The shoe counter blank and shoe upper will then be shaped to form the heel region of the shoe. This operation is generally performed in combination with affixing the shoe counter to the shoe's upper by a heat molding step. The heat molding step will both shape the thermoplastic-resin containing nonwoven composite as well as activate a hot melt adhesive (if this type of adhesive is used to affix the counter to the shoe's upper). The heat molding step will form the shoe counter blank into the finished shoe counter which is generally shaped to conform to the lateral exterior surface of the human heel and provide stiffness to the heel region of the shoe. The shoe counter comprises a first surface and a second surface opposite said first surface wherein the first surface is concave and the second surface is convex thereby forming a concavo-convex structure wherein said concavo-convex structure is generally shaped to conform to the lateral exterior surface of the human heel and provide stiffness to the heel region of a shoe. The first surface is the velvety or felt surface substantially free of thermoplastic resin, of said nonwoven composite which was formed in the absence of buffing. The second surface is the fused surface of said nonwoven composite which may be coated with an adhesive.

That which is claimed is:

1. A nonwoven fabric made from staple fiber selected from the group consisting of polypropylene fibers, cellulose acetate fibers, nylon fibers, acrylic fibers, and combinations of two or more thereof, with a denier in the range of from about 1½ denier to about 10 denier, wherein said staple fibers have been formed into a batt which is needle punched with in the range of about 500 to about 2000 needle punches/square inch in a manner which provides a nonwoven fabric weighing in the range of from about 6 ounces/square yard to about 10 ounces/square yard, with a thickness of from about 65 mils to about 90 mils having a velvety or felt like first fabric surface wherein said nonwoven fabric has a second fabric surface which has a light surface fusion.

2. The nonwoven fabric of claim 1 wherein the staple fiber is polypropylene.

3. The staple fiber of claim 1 wherein the denier ranges from about 3 denier to about 5 denier.

4. The nonwoven fabric of claim 1 wherein the thickness of the nonwoven fabric ranges from about 65 mils to about 80 mils.

5. The nonwoven fabric of claim 1 wherein the staple fiber is polypropylene, the denier is in the range of from about 3 denier to about 5 denier, and the thickness of the nonwoven fabric is in the range of from about 65 mils to about 80 mils.

6. The nonwoven fabric of claim 5 wherein the needle punches/square inch is in the range from 1,000 to 1,200 needle punches/square inch.

7. A process for making a nonwoven fabric consisting essentially of:

(a) forming a carded web of staple fiber wherein said staple fiber is selected from the group consisting of polypropylene fibers, cellulose acetate fibers, nylon fibers, acrylic fibers, and combinations of two or more thereof, having a denier in the range of from about 1½ denier to about 6 denier;

(b) crosslapping said carded web to for a suitable batt;

(c) needle punching said batt with a needle punch density of from about 500 to about 2000 needle punches/square inch to form a fabric having a first velvety or felt like fabric surface and a second fabric surface opposite to said first surface;

(d) fusing said second surface in a manner which provides a light fusion of the staple fibers making up said second surface;

thereby providing a nonwoven fabric weighing in the range of from about 6 ounces/square yard to about 10 ounces/square yard with a thickness of from about 65 mils to about 90 mils.

8. The process of claim 7 wherein the thickness of the nonwoven fabric is in the range of from about 65 mils to about 80 mils.

9. The process of claim 7 wherein the fusing is accomplished by applying a hot calendar roll to the second fabric surface.

10. The process of claim 7 wherein the fusion is accomplished by exposing the second fabric surface to an infrared heat source followed by cold calendar rolling to plastize the outer surface only.

11. The process of claim 7 wherein after said fabric is formed but before said fabric is fused the fabric is cold pressed to reduce the loft of the fabric.

12. The process of claim 7 wherein the needle punching is performed with needles varying from about 32 to about 40 gauge.

13. The process of claim 7 wherein the needle punching is performed with a reduced stroke to provide a smooth first surface.

14. The process of claim 7 wherein the staple fiber is polypropylene.

15. A process for making a nonwoven fabric consisting essentially of:

(a) forming a carded web of a staple fiber wherein said staple fiber is selected from the group consisting of polypropylene fibers, cellulose acetate fibers, nylon fibers, acrylic fibers, and combinations of two or more thereof, and having a denier in the range of from about 3 denier to about 5 denier;

(b) crosslapping said carded web to form a suitable batt;

(c) needle punching said batt with a needle punch density of from about 1000 to about 1200 needle punches/square inch to form a fabric having a first velvety of felt like fabric surface and a second fabric surface opposite to said first surface;

(d) fusing said second surface in a manner which provides a light fusion of the staple fibers making up said second surface;

thereby providing a nonwoven fabric weighing in the range of from about 8 ounces/square yard to about 9.4 ounces/square yard with a thickness of from about 65 mils to about 80 mils.

16. The process of claim 15 wherein the fusing is accomplished by applying a hot calendar roll to the second fabric surface.

17. The process of claim 15 wherein the fusion is accomplished by exposing the second fabric surface to an infrared heat source followed by cold calendar rolling to plastize the outer surface only.

18. The process of claim 15 wherein after said fabric is formed but before said fabric is fused the fabric is cold pressed to reduce the loft of the fabric.

19. The process of claim 15 wherein the needle punching is performed with needles varying from about 32 to about 40 gauge.

20. The process of claim 15 wherein the needle punching is performed with a reduced stroke to provide a smooth first surface.

* * * * *